United States Patent [19]

Seko et al.

[11] 4,276,130

[45] Jun. 30, 1981

[54] PROCESS FOR THE PRODUCTION OF HIGH PURITY AQUEOUS ALKALI HYDROXIDE SOLUTION

[75] Inventors: Maomi Seko, Tokyo; Shinsaku Ogawa; Reiji Takemura, both of Nobeoka, all of Japan

[73] Assignee: Asahi Kasei Kogyo Kabushiki Kaisha, Osaka, Japan

[21] Appl. No.: 42,304

[22] Filed: May 25, 1979

Related U.S. Application Data

[63] Continuation of Ser. No. 856,484, Dec. 1, 1977, abandoned, which is a continuation of Ser. No. 703,234, Jul. 7, 1976, abandoned.

[30] Foreign Application Priority Data

Jul. 11, 1975 [JP] Japan ..... 50-85777

[51] Int. Cl.[3] ..... C25B 1/16; C25B 1/26

[52] U.S. Cl. ..... 204/98; 204/128

[58] Field of Search ..... 204/98, 128

[56] References Cited

U.S. PATENT DOCUMENTS

| | | | |
|---|---|---|---|
| 3,773,634 | 11/1973 | Stacey et al. | 204/98 |
| 3,904,496 | 9/1975 | Harke et al. | 204/98 |
| 3,933,603 | 1/1976 | Ishida et al. | 204/98 |
| 4,025,405 | 5/1977 | Dotson et al. | 204/98 |

FOREIGN PATENT DOCUMENTS 955307 4/1964 United Kingdom .

*Primary Examiner*—Leland A. Sebastian

*Attorney, Agent, or Firm*—Birch, Stewart, Kolasch and Birch

[57] ABSTRACT

High purity aqueous alkali hydroxide solutions containing predetermined, low concentrations of alkali metal halide are obtained in the anode compartment of an electrolytic cell using a cationic ion exchange membrane by conducting the electrolysis under controlled conditions such that the difference between the concentration of alkali metal halide in the anode compartment and the limiting concentration of alkali metal halide in the anode compartment is within a defined range.

6 Claims, 5 Drawing Figures

PROCESS FOR THE PRODUCTION OF HIGH PURITY AQUEOUS ALKALI HYDROXIDE SOLUTION

This is a continuation, of application Ser. No. 856,484 filed Dec. 1, 1977, which is in turn a continuation of application Ser. No. 703,234 filed July 7, 1976, now abandoned.

This invention relates to methods for the manufacture of high purity aqueous solutions of alkali metal hydroxides, which comprises effecting the electrolysis of an aqueous solution of alkali halide in an electrolytic cell divided into an anode compartment and a cathode compartment by a cation exchange membrane while keeping the difference between the concentration of alkali halide (expressed in equivalents per cubic centimeter) in the anode compartment and the limiting concentration of alkali halide in the anode compartment in a preselected range. The processes are particularly useful for the production of high purity aqueous sodium hydroxide by electrolysis of aqueous sodium chloride solution.

Electrolytic processes employing ion exchange membranes have attracted considerable commercial attention as a result of public pressure to conduct commercial procedures without adverse environmental impact. Operation of these processes on a commercial scale, however, has many problems. For example, the production of pure aqueous alkali metal hydroxides by electrolysis of aqueous alkali metal halides is difficult, since most cation exchange membranes permit migration of alkali metal halide from the anode compartment. This migration causes contamination of the alkali metal hydroxide which is normally formed in the cathode compartment.

There are three possible methods for dealing with this problem. One is to construct the membrane so as to inhibit the migration of alkali metal halide. Another is to increase the current density so as to increase the amount of alkali metal hydroxide compared to the amount of migrating alkali metal halide. A third possibility is to decrease the concentration of alkali metal halide in the anode compartment. None of these procedures is completely satisfactory.

For convenience in the further description of this invention, it will be described as directed to the production of sodium hydroxide from sodium chloride. It is, of course, not so limited. As a further convenience in describing the invention, certain of the units employed will be defined. In this disclosure and claims, the following symbols will have the meanings indicated:

d = membrane thickness in cm.

D = diffusion coefficient of alkali halide in the membrane in $cm^2\ sec^{-2}$.

R = electrical resistance of the membrane per unit area in ohm $cm^2$.

I = current density in amp. $cm^{-2}$.

$W_{MX}$ = velocity of migration of metallic halide through the membrane in eq. $cm^{-2}\ sec^{-1}$.

$W_{MOH}$ = velocity of migration of metallic hydroxide through the membrane in eq. $cm^{-2}\ sec^{-1}$.

F = Faraday constant expressed as 96,500 amp sec $eq^{-1}$.

$t_m$ = transport number of alkali metal ions in the membrane.

V = voltage drop in the membrane.

K = proportionality constant in sec $cm^{-3}$ $ohm^{-1}$

C = concentration of alkali metal halide in the anode compartment in eq. $cm^{-3}$.

$C_O$ = limiting concentration of alkali metal halide in the anode compartment in eq. $cm^{-3}$.

$\bar{d}$ = thickness of desalted layer in cm $\bar{D}$ = diffusion coefficient of alkali in the anolyte in $cm^2\ sec^{-1}$ It has been found that if an effort is made to decrease the migration of sodium chloride through the membrane by increasing its thickness, or by making it more compact, the electrical resistance increases at a rate which can be approximated by the following equation. This limits the first approach.

$$(d/D)=KR \tag{1}$$

The second approach has the practical limitation that voltage applied to the ion exchange membrane should be less than two volts. Since the resistance of the membrane is constant, this imposes an upper limit on the current density in accordance with Ohm's Law that V=IR. This practical limit on voltage takes into account such factors as power costs, decomposition voltage, overvoltage at the electrodes and the electrical resistance of the solutions. It is of course apparent that sodium hydroxide cannot be produced commercially if the power costs are so high that the product produced cannot be sold at a competitive price.

The limitation of the third method is that if the concentration of sodium chloride in the anode compartment is lowered to the point where it is less than the limiting concentration $C_O$, there are no sodium ions at the interface between the desalted layer of the anolyte and the cation exchange membrane. As a result, there are no sodium ions to be transported. Additionally, there is a large increase in resistance at the interface due to the presence of substantially deionized water. A decrease in sodium chloride concentration therefore results in the creation of a limiting current density above which there is little or no improvement in the transfer of the desired ions.

It has now been discovered that a relationship exists between the values of $W_{MX}$, $W_{MOH}$, V, $t_m$ and $(C-C_O)$, and that by selecting conditions so that these factors have predetermined values it is possible to produce alkali metal hydroxide aqueous solutions of which the alkali metal halide content is at a selected low level up to 400 ppm based on pure alkali metal hydroxide.

One expression of this relationship is shown by the equation:

$$(W_{MX}/W_{MOH})=(F/KVt_m)(C-C_O) \tag{2}$$

or, more simply:

$$(W_{MX}/W_{MOH})=a(C-C_O)$$

For the production of aqueous sodium hydroxide with a sodium chloride content of less than 400 ppm based on pure sodium hydroxide the electrolysis conditions are controlled so that the value of the expression:

$$(F/KVt_m)(C-C_O)$$

is up to $2.74\times10^{-4}$.

This is a very valuable discovery since it makes possible the selection of cation membranes, voltage, concentrations and other factors related to electrolysis so that the most economical conditions can be employed which are consistant with obtaining aqueous alkali metal hydroxide solutions of predefined alkali halide content.

For example, the rayon industry employs an aqueous sodium hydroxide solution which is normally of a concentration of about twenty-five percent. It is required that the sodium chloride concentration of this solution be no more than 400 ppm based on the sodium hydroxide content. Solutions of this nature can be readily achieved while operating in accordance with this invention.

The value of $\alpha$ is normally determined by the electrolytic cell employed, the membrane employed and economic factors. Therefore, for a selected cell and membrane combination, the process is best controlled by controlling the factor $(C-C_O)$.

The concept of limiting concentration $C_O$ will now be explained in detail with reference to the electrolysis of sodium chloride as an example. Due to the difference in transport number of $Na^+$ through anolyte ($t_{Na}$) and transport number of $Na^+$ through cation exchange membrane ($\bar{t}_{Na}$), there occurs a phenomenon of desalting at the interface of the cation exchange membrane facing the anolyte. As the result, in the anode compartment, the concentration of sodium chloride at said interface is lower than that in the bulk portion of the anolyte. Sodium chloride is transferred from the bulk to the interface by mass transfer due to the difference in the concentration until the concentration of sodium chloride at the interface reaches an equilibrated value. The concentration at the interface is lowered as the concentration of the bulk is lowered and there exists a critical concentration of the bulk($C_O$) where the interface concentration becomes lowered ultimately to zero. The limiting concentration $C_O$ refers to said critical concentration. At said concentration, there is the following relation, as obtained from the mass balance of $Na^+$:

$$(I/F)(t_{Na}-\bar{t}\mathrm{Na})=\bar{D}/dC_O \quad (3)$$

Accordingly, when the concentration of sodium chloride is lower than $C_O$, $Na^+$ ions transferred to the interface of the membrane are insufficient and therefore there occurs a phenomenon of polarization of water, whereby the current efficiency of the cation exchange membrane is decreased. When the cation exchange membrane to be used, the electrolytic cell and other conditions such as current density are selected, $C_O$ can be determined experimentally by the method as hereinafter described. It has been also found that the ratio of $I/C_O$ should preferably be in the range from 150 to 350 A $cm^{-2}$ eq. $cm^{-3}$.

The invention may be better understood by reference to the determination of the value of $(C-C_O)$ with the accompanying drawings in which.

Figure 1:
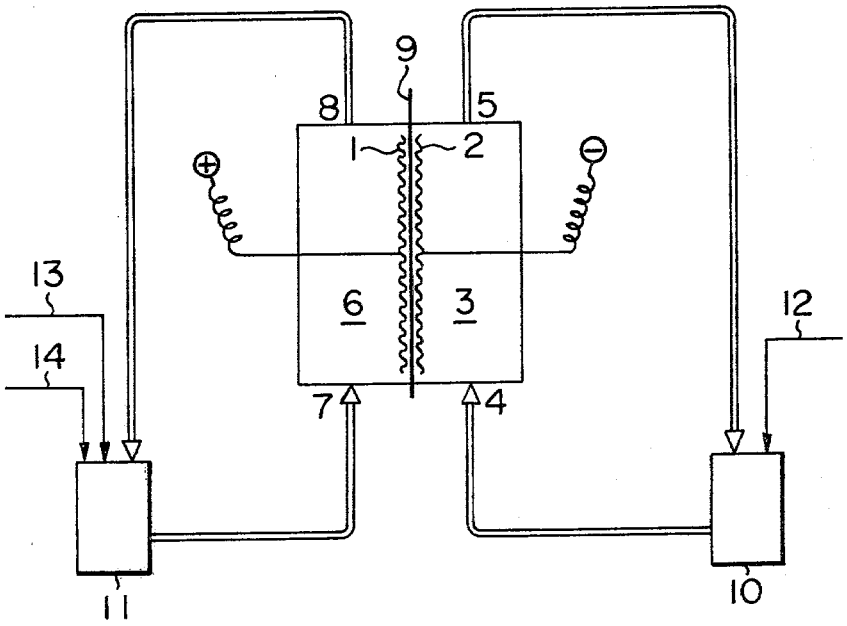
FIG. 1 is a structural diagram of a typical electrolytic cell for use in the invention.

Referring now to FIG. 1 which shows a typical electrolysis cell which can be used in this invention, there is shown an anode 1 and a cathode 2 respectively positioned in anode compartment 6 and cathode compartment 3 separated by cation exchange membrane 9.

Typically, the anode may be a titanium mesh coated with a solid solution comprising ruthenium, titanium or zirconium oxide. The cathode is normally an iron mesh or other material with low hydrogen overvoltage.

Both anode and cathode may be designed to provide an effective area of 25 $cm^2$ for the passage of electric current. The distance between the electrodes is generally adjusted to about 5 mm.

The cathode compartment 3 is connected with an external container 10 through conduits 4 and 5 to provide for circulation of the alkali metal hydroxide. This solution is normally circulated at a rate of about one liter per minute. The concentration of the solution may be controlled by the addition of water through conduit 12.

The anode compartment 6 is connected with an external container 11 for aqueous alkali metal halide through conduits 7 and 8. The halide solution also circulates at a rate of about one liter per minute. An acid such as hydrochloric acid may be fed through conduit 13 to control the pH. The alkali metal halide solution may be fed through conduit 14.

When this cell is utilized for the production of aqueous sodium hydroxide from aqueous sodium chloride the pH of the chloride solution is maintained at about 2, the temperature at from about 90° C., and the sodium chloride solution fed through conduit 14 is saturated. The anode, cathode, their effective areas, and the distance between them will normally be of the materials and of the same order of magnitude as suggested above. However, appreciable variations may be tolerated without adverse effect.

The cation exchange membrane 9 may be selected from a wide variety of available membranes. Typically, it will be a perfluorohydrocarbon polymer membrane substituted with sulfonic acid groups. It may, for example, be a membrane obtained by superimposing a polymer film which is 2 mils in thickness and obtained by copolymerization of tetrafluoroethylene and perfluorosulfonyl vinyl ether at a ratio to give an equivalent weight of about 1500, and a similar film about 4 mils thick with an equivalent weight of about 1100. The resulting composite membrane may be supported with a polytetrafluoroethylene fabric of about 40 mesh comprised of 200 denier filaments. The sulfonyl groups will be hydrolyzed to sulfonic acid groups, and this may take place at any stage in the construction of the supported composite membrane.

As indicated above, the cell in FIG. 1 is merely illustrative.

For example, electrodes in the form of porous plates may be used as anode and cathode to decrease the effect of gas entrapment as much as possible as disclosed in Japanese published unexamined patent applications No. 68477/1976 and No. 32865/1977. The pressure in the cathode compartment may be higher than in the anode compartment so that the membrane is pressed toward the anode. By employing this design, the desalted layer is reduced by agitation of the force of the chlorine gas generated from the anode.

It is likewise desirable to inhibit the formation of scale such as of hydroxide at the interface of the membrane on the anode side. This may be accomplished by refining the anolyte as much as possible, or by acidifying the anolyte.

Elevation of the electrolysis temperature as much as possible is also effective in increasing the value of $\overline{D}$, decreasing that of $\overline{d}$ and lowering the electric resistance. Electrolysis conducted under atmospheric pressure at temperatures above 95° C., however, is not desirable because the water in the desalted layer boils, and this shuts off the flow of electric current to increase the electrolytic voltage. Under atmospheric pressure, therefore, the optimum electrolytic temperature is from 80° C. to 95° C.

The cation exchange membrane selected should resist the corroding action of chlorine gas, hydrogen gas, caustic soda and aqueous solutions of sodium chloride, and should have ample mechanical strength. Additionally, the value of $R/t_m$ should be as low as possible.

The membranes described above adequately meet these criteria, but other useful cation exchange membranes will be known to those skilled in the art. These membranes may be substituted with carboxylic, phosphoric, or sulfonamide groups as well as with sulfonic groups.

In order to limit the rise of voltage due to gas entrapment, it is desirable to insert an empty space behind the porous-plate electrode and, on the other hand, to decrease the distance between the two electrodes as much as possible.

The transport number $t_m$ is affected by the concentration of caustic soda in the catholyte. The electrolytic voltage begins to increase as the concentration of caustic soda exceeds 25 percent. The invention is therefore must effectively employed for the production of solutions up to 25% concentration. Addition of water to the solution circulating through the compartment is a possible measure which may be used to improve the transport number. This procedure is illustrated in FIG. 1. This figure also illustrates the addition of hydrochloric acid or some other acid to neutralize the hydroxyl group, control the pH, prevent generation of oxygen gas from the anode and inhibit the formation of hydroxide scale on the surface of the membrane.

In order to enjoy the optimum benefits of this invention, it is preferred to operate under conditions such that the factors in the equation set forth above have the following values:

F is 96,500 amp sec $eq^{-1}$ $C-C_O$ is 0 to 0.001 eq $cm^{-3}$,

K is from $0.8\times10^5$ to $1.67\times10^5$ sec $cm^{-3}$ $ohm^{-1}$,

V is from 0.3 to 2, and $t_m$ is 0.7 to 0.98.

These values can be determined by mathematical calculation based on a few readily conducted observations.

The determination of the value of $C-C_O$ can be conducted as follows:

First, the anolyte and the catholyte are circulated for one hour in a cell such as described above in the absence of passage of electric current with the concentration of sodium chloride in the aqueous solution fixed at 1.0, 2.5 or 4.0 N. The amount of sodium chloride which migrates into the cathode compartment from the anode compartment is measured.

The ratio D/d is calculated from the following formula when the amount of migration of sodium chloride from the anode compartment to the cathode compartment through a unit area of the cation exchange membrane in the absence of passage of electric current and the difference of concentration of sodium chloride between the anode compartment and the cathode compartment ($C-C_2$) are found through actual measurement.

$$(D/d)=[W_{NaCl}]_O/(C-C_2) \quad (4)$$

wherein $[W_{NaCl}]_O$ is the amount of migration of sodium chloride in eq $cm^{-2}$ in the absence of passage of electric current and $C_2$ is the concentration of sodium chloride along the interface of the membrane on the cathode side. This value is approximately zero. The results of a typical observation are enumerated in the following table.

TABLE 1

| Concentration of anolyte (eq $cm^{-3}$) | $(W_{NaCl})O$ (eq/sec . $cm^2$) | d/D |
|---|---|---|
| 0.001 | $3.37\times10^{-9}$ | $2.97\times10^5$ |
| 0.0025 | $5.72\times10^{-9}$ | $4.37\times10^5$ |
| 0.004 | $10.39\times10^{-9}$ | $3.85\times10^5$ |
| Average | | $3.73\times10^5$ |

Figure 2:
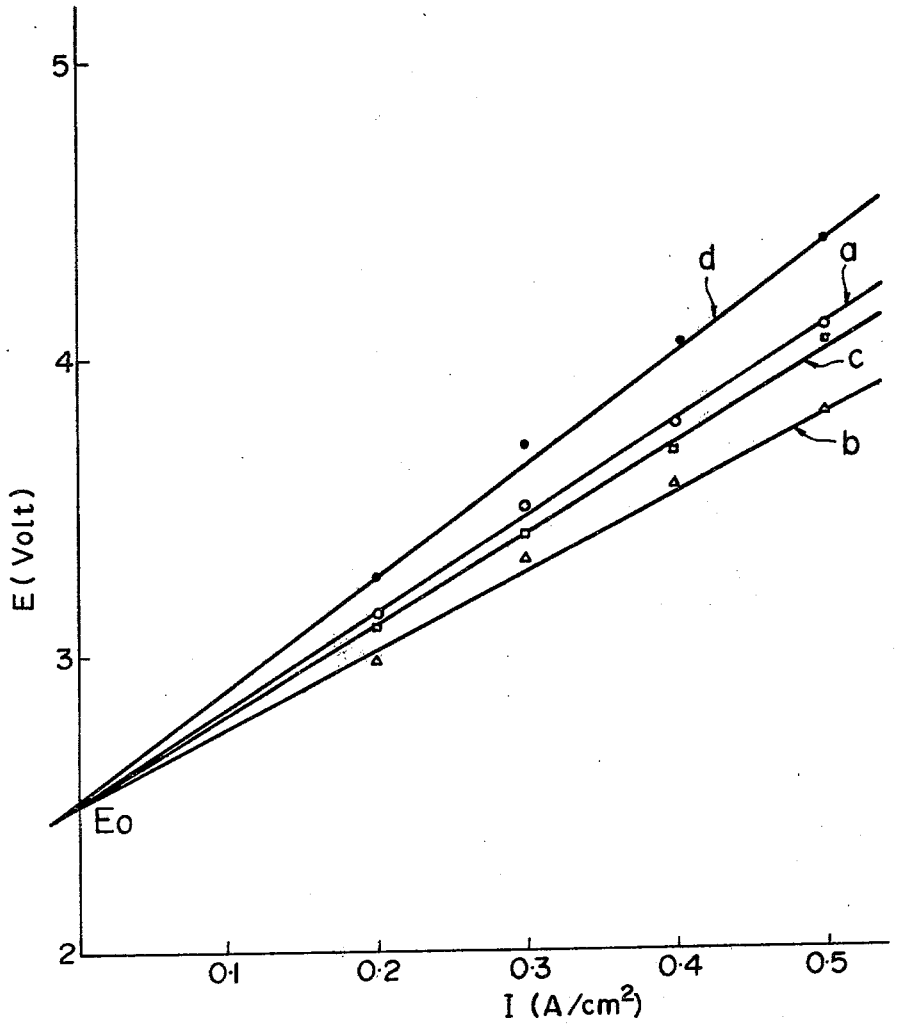
FIG. 2 is a graph of voltage plotted against current density.

FIG. 2 is a graph obtained by passing electric current through a 4.0 N aqueous solution of sodium chloride while carrying the current density from 0.2, 0.3, 0.4 and 0.5 amp $cm^{-2}$, measuring the cell voltage E and plotting the results of measurement as the function of the current density I.

The point $E_O$=2.5 V extrapolated to I=0 represents the voltage of the electrode and $E-E_O$ represents the voltage drop due to the membrane and the liquid.

The data based on this experiment is shown in line 'a' of FIG. 2.

Figure 3:
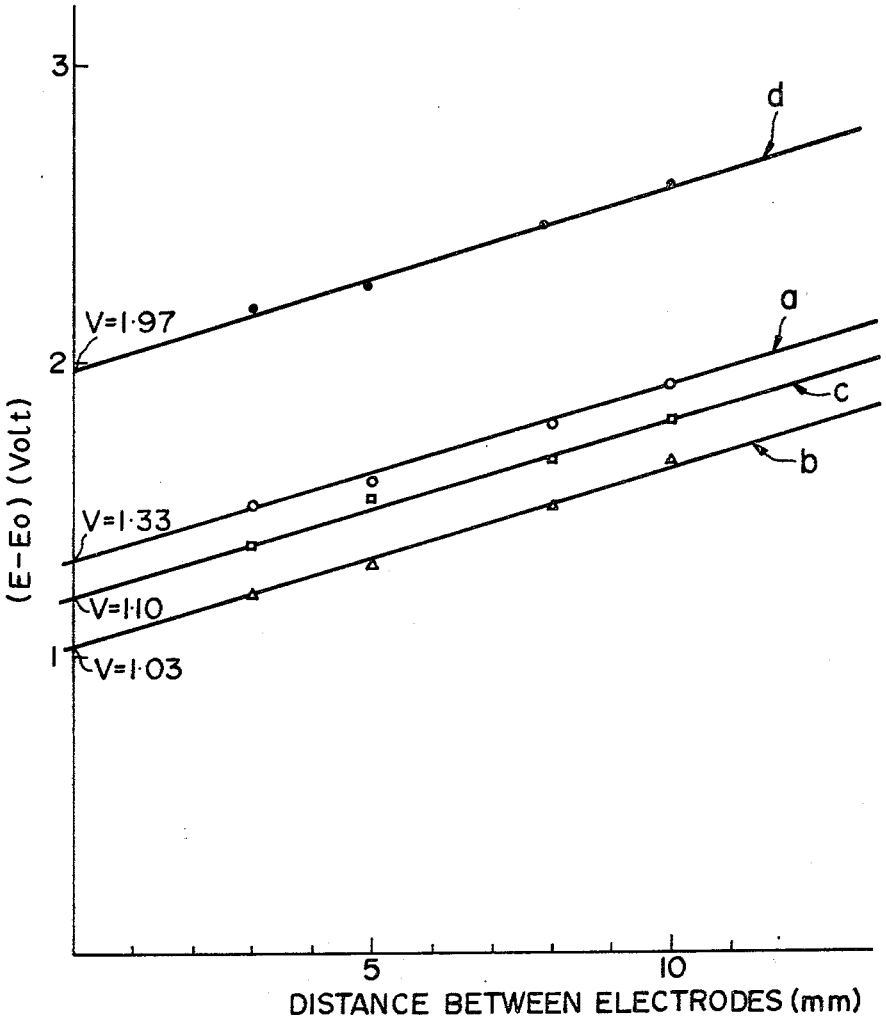
FIG. 3 is a graph of the voltage loss in ohms of an electrolytic cell plotted against the distance between the electrodes.

The information from FIG. 3 may be employed to determine the value of K.

FIG. 3 is a graph obtained by varying the distance between the electrodes at a fixed anolyte concentration of 4.0 N and a fixed current density of 0.5 amp $cm^{-2}$, measuring the cell voltage and plotting the difference of $E-E_O$ as a function of the distance, l, between the electrodes. In FIG. 3, the line a shows the results of this experiment. In this graph, the point V=1.33 volts extrapolated to l=0 represents the voltage drop due to the membrane alone. The electric resistance of the cation exchange membrane is found from Ohm's law, R=V/I, as follows:

$$R=(1.33/0.5)=2.66 \text{ ohm cm}^{-2}$$

The value of K calculated from the data in Table 1, FIG. 1, FIG. 2 and FIG. 3 is $$K=\frac{d}{D}\times\frac{1}{R}$$
$$=3.73\times10^5\times\frac{1}{2.66}=1.40\times10^5.$$

Subsequently, a test of passage of electric current is continued for ten hours at a current density of 0.5 amp $cm^{-2}$ with the concentration of sodium chloride in the aqueous solution varied from 1.0 N, 1.5 N, 2.0 N, 2.5 N to 4.0 N. The current efficiency is calculated from the increase in the caustic soda content of container 10.

Figure 4:
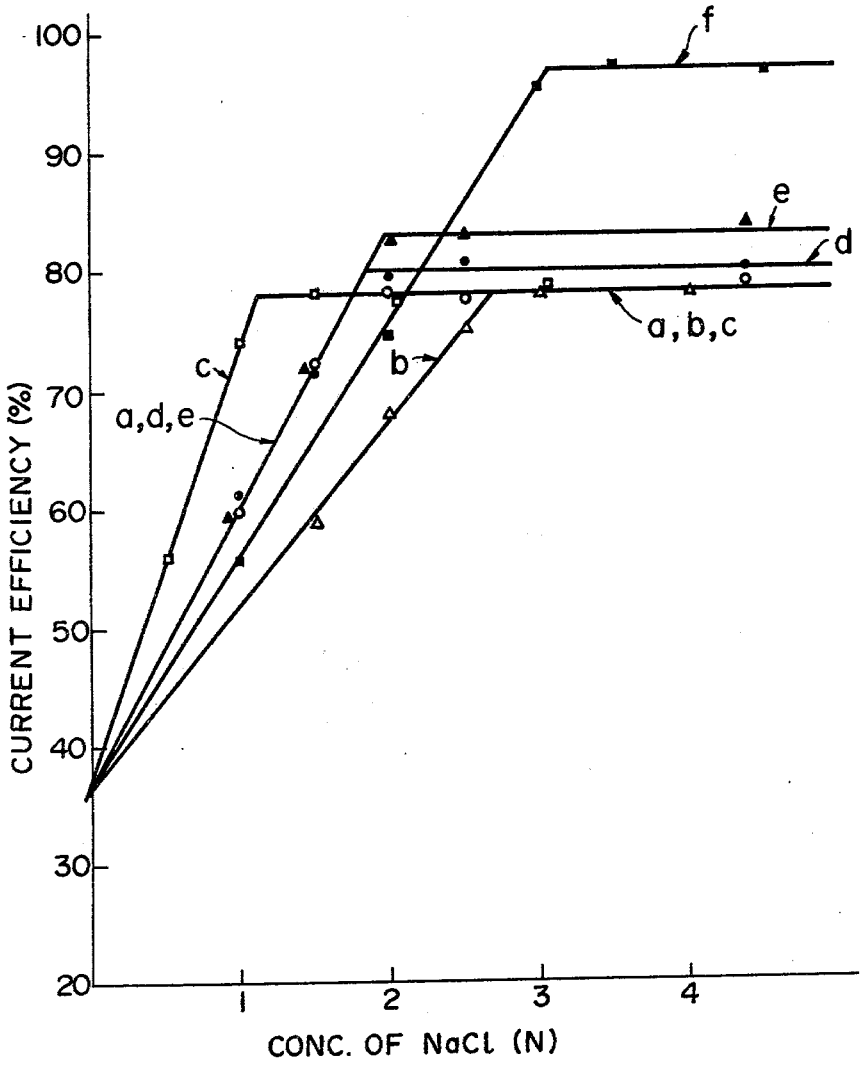
FIG. 4 is a graph of current efficiency plotted against concentration of sodium chloride.

The transport number $t_{Na}$ is calculated from the data of FIG. 4 in which current efficiency is plotted against concentration of sodium chloride in aqueous solution. The concentration at the point where there is a sharp inflection in current efficiency is the limiting concentration. The transport number is the percent current efficiency expressed as a decimal. From this graph, line a shows the value of $t_{Na}$ to be 0.78 and $C_O$ to be 1.76 N.

Substitution of the numerical values of K, V and $t_{Na}$ in the equation set forth above gives the following results:

$$\frac{W_{NaCl}}{W_{NaOH}} = \frac{F}{K.V.t_{Na}}(C - C_O) = 0.662\,(C - C_O)$$

Then, $(W_{NaCl}/W_{NaOH})$ is otherwise expressed in terms of ppm units as follows:

$$\left(\frac{W_{NaCl}}{W_{NaOH}}\right) = \frac{W_{NaCl} \times 58.5}{W_{NaOH} \times 40} \times 10^6 = 0.967 \times 10^6\,(C - C_O)$$

Figure 5:
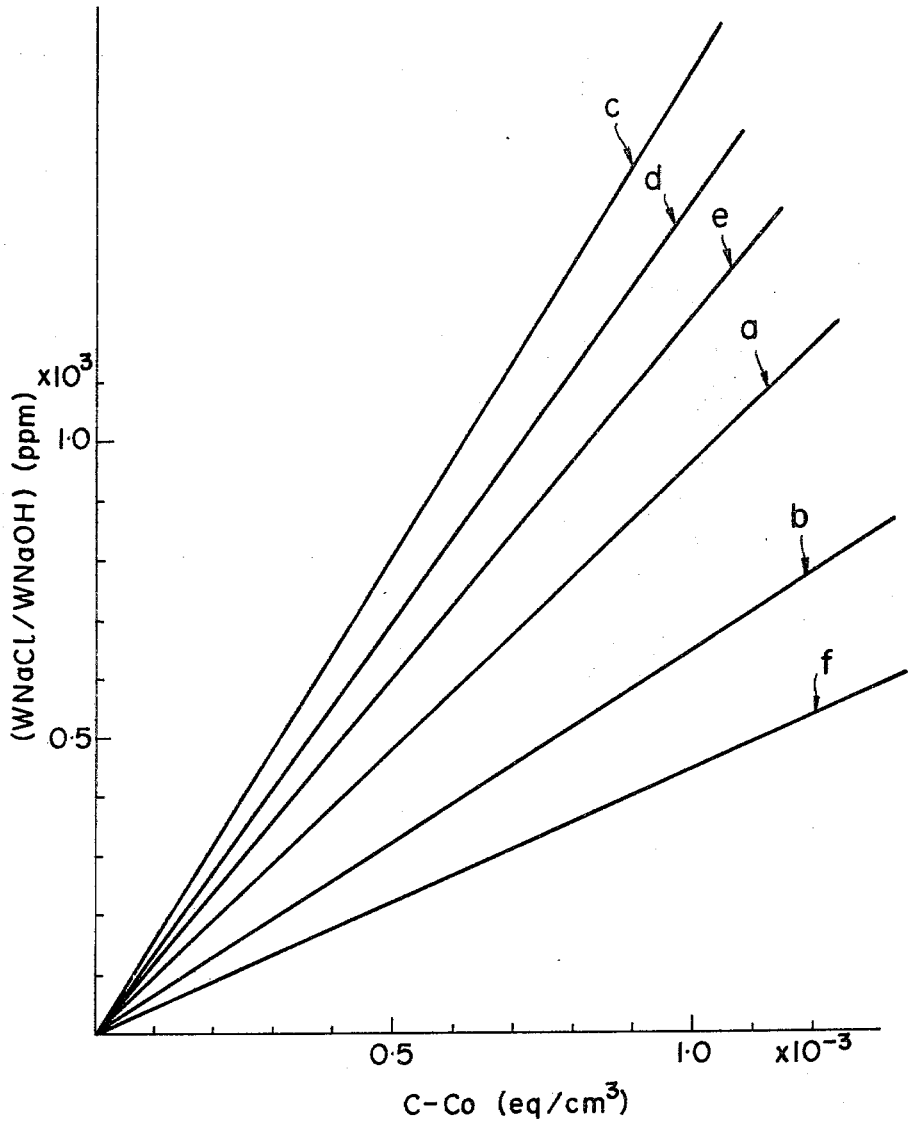
FIG. 5 is a graph of $W_{NaCl}/W_{NaOH}$ plotted against $(C-C_O)$.

By graphically representing this formula with $(W_{NaCl}/W_{NaOH})$ indicated in the vertical axis and $(C-C_O)$ in the horizontal axis, there is obtained a line a in FIG. 5.

From this graph, it is seen that when the operation is performed at a current density of 0.5 A/cm$^2$, the condition $C-C_O<0.4\times10^{-3}$ eq cm$^{-3}$ must be satisfied to keep the sodium chloride content in the caustic soda produced below 400 ppm.

Reference is again made to the preferred ranges for the various factors set forth above.

It has been observed that if the value of $t_m$ is less than 0.7, then the cation exchange membrane does not function effectively. Conversely, an ideal membrane satisfying the maximum $t_m=1.0$ is, in reality, difficult to manufacture on a commercial scale. For practical purposes, $t_m$ is preferred to be from 0.80 to 0.98. This factor $t_m$ is chiefly determined by the method adopted for the production of the cation exchange membrane, although it may also be affected by the concentration of caustic soda in the cathode compartment, the current density, etc. Once these factors are fixed, this term $t_m$ assumes a high constant value as long as the concentration of sodium chloride in the bulk layer within the anode compartment exceeds $C_O$.

The value of $t_m$ can also be determined directly by measuring the amount of caustic soda produced and the amount of electric current passed.

The term V represents the voltage drop in the membrane. The value of V can be either determined by the method described above or calculated from Ohm's law, V=IR, if the electric resistance of the ion exchange membrane has already been determined.

The value of V can also be determined directly by disposing Luggin capillaries, one each on either side of the cation exchange membrane, taking measurement of the voltage difference between the opposed Luggin capillaries with the reference electrodes during the electrolysis and, based on the results of the measurement, correcting the voltage drop by the anolyte and catholyte. For an economic reason, the value of V should not be more than 2 volts. Preferably, it should be not more than 1 volt. On the other hand, it is difficult to lower the value of V to less than 0.3 volt.

An attempt to decrease the value of R below 1.5 ohm cm$^2$ results in an excessively small membrane thickness, insufficient compactness of membrane texture or enhanced susceptibility of the membrane to swelling, making it no longer possible to increase the value of $t_m$ above 0.7. As a result, the membrane is deprived of its inherent ion-exchange function.

An increase in the value of I results in an increase in the power requirement for electrolysis. If the value of I is too small, then the construction cost for the electrolytic cell is increased. Generally, the optimum current density is determined such that the sum of the cost of electric power for electrolysis and the depreciation of the construction cost of the electrolytic cell is at a minimum. For this economic reason, the current density I generally is selected at from 1 amp cm$^{-2}$ to 0.05 amp cm$^{-2}$, preferably from 0.6 to 0.2 amp cm$^{-2}$.

For the value of $t_m$ to exceed 0.7, R should have a value of not less than 1.5 ohm cm$^2$. Even at a current of 0.2 amp cm$^{-2}$, R<10 ohm cm$^2$ must be satisfied in order to ensure V<2 volts. The practical range of R, therefore, is 1.5 to 10 ohm cm$^2$.

As the thickness of the membrane increases, the electric resistance also increases. Practically, it should not be greater than about 0.3 cm. Because of present manufacturing difficulties, the thickness of the membrane is rarely below 0.003 cm. When a thin membrane is adopted, it is frequently backed with a reinforcing material as described above. With such backed membranes, it is difficult to determine d and D accurately. It is sufficient that the ratio d/D can be determined through actual measurement.

Possible values of K actually calculated from various cation exchange membrane fall approximately in the range from $0.8\times10^5$ to $1.67\times10^5$ sec cm$^{-3}$ ohm$^{-3}$ with reference to the electrolysis of sodium chloride. Thus, with reference to the electrolysis of sodium chloride, the values of the factors in formula (2) are preferably the following:

$W_{NaCl}/W_{NaOH}$ is up to $2.74\times10^{-4}$
F is 96,500 amp.sec.eq$^{-1}$
$t_{Na}$ is from 0.70 to 0.98
V is from 0.3 to 2.0 volt
K is from $0.8\times10^5$ to $1.67\times10^5$ sec.cm$^{-3}$·ohm$^{-1}$ Therefore, the possible maximum value of the difference $(C-C_0)$ among the permissible range to be determined depending on the parameter as mentioned above is 0.001 eq cm$^{-3}$.

Now, the construction of the electrolytic cell and the operating conditions thereof which are advantageous in the practice of this invention will be described.

As is plain from formula (3), the value of $C_O$ can be decreased and that of I can be increased in proportion as the value of $\bar{d}$ decreases. The percent utilization on the aqueous sodium chloride solution improves with the decreasing value of $C_O$ and the construction cost of the electrolytic cell decreases with the increasing value of I. A decrease in the value of $\bar{d}$ results in a decrease in the electric resistance of the desalted layer. Since all these conditions are highly advantageous from the economic point of view, it is commercially desirable to reduce the value of $\bar{d}$ as much as possible.

For this purpose, it is wise to improve the condition of flow of liquid in the anode compartment. As the construction of the electrolytic cell and the operating conditions thereof, there can be utilized various devices and methods.

EXAMPLE 1

The apparatus shown in FIG. 1 (following the conditions determined by the methods described above) is used for electrolysis.

Electric current is passed at a current density of 0.5 amp $cm^{-2}$ through 2.0 N aqueous sodium chloride solution with the value of $(C-C_O)$ at 0.24 N. The current efficiency and the sodium chloride content in the caustic soda are calculated from the amount of caustic soda produced, and the sodium chloride concentration in the aqueous caustic soda solution. The current efficiency is found to be 78 percent and the sodium chloride content in the caustic soda to be 210 ppm per pure caustic soda. The sodium chloride concentration in the aqueous caustic soda solution substantially levelled off after about 40 hours.

For the purpose of reference, a similar test of passage of electric current is effected at a sodium chloride concentration of 2.5 N and a $(C-C_O)$ value of 0.74 N. The results are 78 percent of current efficiency and 640 ppm of sodium chloride content in caustic soda.

EXAMPLE 2

The same electrolytic cell and ion exchange membrane as those in Example 1 are used.

Passage of electric current at a current density of 0.75 amp $cm^{-2}$ is continued for ten hours with the concentration of sodium chloride in the aqueous solution varied from 1.5 N, 2.0 N, 3.0 N to 4.0 N. The current efficiency is calculated from the increase in the amount of caustic soda in container 10. The line b in FIG. 4 is a graph obtained by plotting the current efficiency against the concentration of sodium chloride in the aqueous solution.

From this graph, $t_{Na}$ and $C_O$ are found to be 0.78 and 2.7 N.

The line b in FIG. 5 is a graphical representation of the relation obtained. It is seen from this graph that when the operation is carried out at a current density of 0.75 amp $cm^{-2}$, the condition $(C-C_O)<0.6\times10^{-3}$ eq $cm^{-3}$ must be satisfied to control the sodium chloride content in the caustic soda below 400 ppm.

Therefore, a test of passage of electric current at a current density of 0.75 amp $cm^{-2}$ is continued for 50 hours with the sodium chloride concentration in the aqueous solution fixed at 3.0 N and the difference of concentration, $(C-C_O)$, fixed at 0.3 N. From the increase in the amount of caustic soda in container 10 and the concentration of sodium chloride in the aqueous soda caustic soda solution, the current efficiency and the sodium chloride content of caustic soda are found to be 78 percent and 180 ppm per pure caustic soda respectively. The concentration of sodium chloride in the aqueous caustic soda solution is substantially constant after 30 hours of test.

For comparison, the passage of electric current is effected as described above with the concentration of sodium chloride in the aqueous solution fixed at 4.0 N and the difference of concentration, $(C-C_O)$, at 1.3 N. The current efficiency is found to be 78 percent and the sodium chloride content in the caustic soda to be 880 ppm.

EXAMPLE 3

The same electrolytic cell and the same ion exchange membrane as in Example 1 are used.

Passage of electric current at a current density of 0.30 amp $cm^{-2}$ is continued for 10 hours each at 0.5 N, 1.0 N, 1.5 N, 2.0 N and 3.0 N sodium chloride concentration. The current efficiency is found from the increase in the amount of caustic soda in container 10. By plotting the current efficiency as a function of the concentration of sodium chloride in the aqueous solution, line c of FIG. 4 is obtained.

From this graph, values of $t_{Na}$ and $C_O$ are found to be 0.78 and 1.10 N.

Line c in FIG. 5 is a graphic representation of the result obtained.

It is seen from this graph that when the operation is performed at a current density of 0.30 amp $cm^{-2}$, the condition $(C-C_O)<0.25\times10^{-3}$ eq $cm^{-3}$ must be satisfied to control the sodium chloride content of the caustic soda below 400 ppm.

Therefore, a test of passage of electric current at a current density of 0.30 amp $cm^{-2}$ is continued for 100 hours with the sodium chloride concentration in the aqueous solution fixed at 1.3 N and the difference of concentration, $(C-C_O)$, at 0.2 N. From the increase in the amount of caustic soda in container 10 and the sodium chloride concentration in the aqueous caustic soda solution both measured in the test, the current efficiency and the sodium chloride content of the caustic soda are found to be 78 percent and 350 ppm respectively. The concentration of sodium chloride in the aqueous caustic soda solution is substantially constant after about 70 hours.

For comparison, a similar test of passage of electric current is effected with the concentration of sodium chloride in the aqueous solution fixed at 2.0 and the difference of concentration, $(C-C_O)$, at 0.90 N. Consequently the current efficiency is found to be 78 percent and the sodium chloride content of the caustic soda to be 1430 ppm.

EXAMPLE 4

The same electrolytic cell as that of Example 1 is used. The cation exchange membrane used is a sulfonic acid form membrane which is obtained by joining face to face a membrane 1.5 mils in thickness resulting from the copolymerization of tetrafluoroethylene and perfluorosulfonyl vinyl ether at a ratio to give an equivalent weight of 1500 and a membrane 4 mils in thickness resulting from the copolymerization of said monomers at a ratio to give an equivalent weight of 1100, incorporating in the resultant composite membrane a backing of a 15-mesh fabric woven with 200-denier Teflon filaments and subsequently subjecting the reinforced composite membrane to hydrolysis.

The value of d/D was determined as described above from the data set forth in Table 2.

TABLE 2

| Concentration of anolyte [eq.$cm^{-3}$] | $[^{W}NaCl]O$[eq sec . $cm^{-2}$] | d/D |
|---|---|---|
| 0.001 | $3.32\times10^{-9}$ | $3.01\times10^{5}$ |
| 0.0025 | $10.26\times10^{-9}$ | $2.44\times10^{5}$ |
| 0.004 | $18.98\times10^{-9}$ | $2.11\times10^{5}$ |
| Average | | $2.52\times10^{5}$ |

The voltage and the current density are plotted to obtain the line d in FIG. 2. By plotting $(E-E_O)$ as the function of the distance l between the electrodes, the line d in FIG. 3 is obtained. Thus, the electric resistance R of the cation exchange membrane is found to be $$R=(V/I)=(1.03/0.5)=2.06 \text{ ohm cm}^2$$

The constant K is calculated as follows:

$$K=\frac{d}{D}\times\frac{1}{R}=2.52\times10^{5}\times\frac{1}{2.06}$$

-continued $$= 1.22 \times 10^5$$

Subsequently, a test of passage of electric current at a current density of 0.5 amp $cm^{-2}$ was continued at 1.0 N, 1.5 N, 2.0 N, 2.5 N and 4.0 N sodium chloride concentration. The current efficiency is calculated from the increase in the amount of caustic soda in container 10. By plotting the current efficiency as the function of the concentration of sodium chloride in the aqueous solution, the line d in FIG. 4 is obtained.

From this graph, the values of $t_{Na}$ and $C_O$ are found to be 0.80 and 1.85 N.

The line d in FIG. 5 is a graphic representation of the result obtained.

From this graph, it is seen that when the operation is effected at a current density of 0.5 amp $cm^{-2}$, the condition $(C-C_O)<0.3\times10^{-3}$ eq. $cm^{-3}$ must be satisfied to control the sodium chloride content of the caustic soda produced below 400 ppm.

Therefore, a test of passage of electric current at a current density of 0.5 amp $cm^{-2}$ is continued for 50 hours with the concentration of sodium chloride in the aqueous solution fixed at 2.0 N and the difference of concentration, $(C-C_O)$, at 0.15 N. From the increase in the amount of caustic soda in container 10 and the sodium chloride concentration in the aqueous caustic soda solution both found in said test, the current efficiency and the sodium chloride content of the caustic soda are found to be 80 percent and 200 ppm per pure caustic soda respectively. The sodium chloride concentration in the aqueous caustic soda solution is substantially constant after about 40 hours of test.

For comparison, a similar test of passage of electric current is effected with the sodium chloride concentration in the aqueous solution fixed at 2.5 N and the difference of concentration, $(C-C_O)$, at 0.65 N. The current efficiency is found to be 80 percent and the sodium chloride content of caustic soda to be 910 ppm.

EXAMPLE 5

The same electrolytic cell as in Example 1 is used. The ion exchange membrane is obtained by joining face to face a membrane 1 mil in thickness resulting from the copolymerization of tetrafluoroethylene and perfluorosulfonyl ether at a ratio to give an equivalent weight of 1500 and a membrane 4 mils in thickness resulting from the copolymerization of said monomers at a ratio to give an equivalent weight of 1100, incorporating in the resultant composite membrane a backing of a 40-mesh fabric woven with 200-denier Teflon filaments and subjecting the reinforced composite membrane to hydrolysis.

The data in Table 3 was determined as described above.

TABLE 3

| Concentration of anolyte [eq $cm^{-3}$] | $[^{W}NaCl]O$[eq sec $cm^{-2}$] | d/D |
|---|---|---|
| 0.001 | $3.55 \times 10^{-9}$ | $2.82 \times 10^5$ |
| 0.0025 | $8.19 \times 10^{-9}$ | $3.05 \times 10^5$ |
| 0.004 | $15.43 \times 10^{-9}$ | $2.59 \times 10^5$ |
| Average | | $2.82 \times 10^5$ |

By measuring the voltage and the current density as described above, and then plotting the found values, the line c in FIG. 2 is obtained. By plotting $(E-E_O)$ as the function of the distance l between the electrodes, the line c in FIG. 3 is obtained. Thus, the electric resistance of this membrane is calculated as follows $$R=(V/I)=(1.10/0.5)=2.20 \text{ ohm cm}^2$$

The constant K is calculated as follows.

$$K = \frac{d}{D} \times \frac{1}{R} = 2.82 \times 10^5 \times \frac{1}{2.20}$$

$$= 1.28 \times 10^5$$

Subsequently, the values of $t_{Na}$ and $C_O$ are found to be 0.83 and 2.0 N, respectively. The line e in FIG. 4 represents the relation between the current efficiency and the sodium chloride concentration in the aqueous solution.

The line e in FIG. 5 is a graphic representation of the result obtained.

From this graph it is seen that when the operation is effected at a current density of 0.5 amp $cm^{-2}$, the condition $(C-C_O)<0.33\times10^{-3}$ eq $cm^{-3}$ must be satisfied to control the sodium chloride content of the caustic soda produced below 400 ppm.

Therefore, a test of passage of electric current at a current density of 0.5 amp $cm^{-2}$ is continued for 50 hours with the sodium chloride concentration in the aqueous solution fixed at 2.05 N and the difference of concentration, $(C-C_O)$, at 0.05 N. From the increase in the amount of caustic soda in container 10 and the sodium chloride concentration in the aqueous caustic soda solution both found in the test, the current efficiency and the sodium chloride content of the caustic soda are found to be 82 percent and 20 ppm respectively. In the test, the sodium chloride concentration in the aqueous caustic soda colution is substantially constant after about 40 hours.

For comparison, a similar test is effected with the sodium chloride concentration in the aqueous solution fixed at 2.5 N and the difference of concentration, $(C-C_O)$, at 0.5 N. Consequently, the current efficiency is found to be 83 percent and the sodium chloride content in the caustic soda to be 600 ppm.

EXAMPLE 6

The same electrolytic cell as used in Examples 1 to 5 is used for electrolysis. The cation exchange membrane used in this Example is prepared by fabricating a copolymer of tetrafluoroethylene and perfluorosulfonyl vinyl ether into a film, followed by backing with 40 mesh fabric woven with 200 denier polytetrafluoroethylene fibers, The one surface of the membrane having sulfonic acid groups formed by hydrolysis is provided with stratum containing carboxylic acid groups. The membrane obtained has an equivalent weight of 1200 g/eq. with the thickness of the stratum containing sulfonic acid groups being 6.6 mils and the thickness of the stratum containing carboxylic acid groups being 0.4 mils.

Following the conditions determined by the methods as described above, the value of d/D was determined to give the results as set forth in Table 4.

TABLE 4

| Concentration of anolyte [eq $cm^{-3}$] | $[^{W}NaCl]O$ [eq. sec . $cm^{-2}$] | d/D |
|---|---|---|
| 0.001 | $1.84 \times 10^{-9}$ | $5.43 \times 10^5$ |
| 0.0025 | $4.47 \times 10^{-9}$ | $5.59 \times 10^5$ |
| 0.004 | $7.83 \times 10^{-9}$ | $5.11 \times 10^5$ |

TABLE 4-continued

| Concentration of anolyte [eq cm$^{-3}$] | [$^{W}$NaCl]O [eq. sec . cm$^{-2}$] | d/D |
|---|---|---|
| Average | | $5.38 \times 10^5$ |

The voltage and the current density are plotted to obtain the line d in FIG. 2. By plotting $(E-E_0)$ as the function of the distance l between the electrodes, at a fixed current density of 0.6 amp cm$^{-2}$, the line d in FIG. 3 is obtained. Thus, the electric resistance R of the cation exchange membrane is found to be $$R=(V/I)=(1.97/0.6)=3.28 \text{ ohm cm}^2$$

The constant K is calculated as follows.

$$K=(d/D)\times l/R=5.38\times 10^5\times 1/3.28=1.64\times 10^5$$

Subsequently, $t_{Na}$ and $C_O$ are determined by the same methods as described above to give the result that $t_{Na}$ is 0.96 and $C_O$ is 3.03 N. The line f in FIG. 4 shows the relationship between the current efficiency and the concentration of sodium chloride.

The line f in FIG. 5 is a graphic representation of the result obtained.

From this graph, it is seen that when the operation is effected at a current density of 0.6 amp cm$^{-2}$, the condition $(C-C_O)<0.88\times 10^{-3}$ eq.cm$^{-3}$ must be satisfied to control the sodium chloride content of the produced caustic soda below 400 ppm.

Therefore, a test of passage of electric current at a current density of 0.6 amp cm$^{-2}$ is continued for 50 hours with the concentration of sodium chloride in the aqueous solution fixed at 3.90 N and the difference of concentration, $(C-C_O)$, at 0.87 N. From the increase in the amount of caustic soda in container 10 and the sodium chloride concentration in the aqueous caustic soda solution, efficiency and the sodium chloride content of the caustic soda are found to be 96 percent and 390 ppm respectively. The sodium chloride concentration in the aqueous caustic soda solution is substantially constant after about 40 hours of test.

For comparison, a similar test of passage of electric current is effected with the sodium chloride concentration fixed at 4.20 N and the difference of concentration, $(C-C_O)$, at 1.17 N. The current efficiency is found to be 96% and the sodium chloride content of caustic soda to be 560 ppm.

What is claimed is:

1. A process for the electrolysis of an aqueous solution of sodium chloride in an electrolytic cell comprising an anode compartment and a cathode compartment separated by a cation exchange membrane to obtain an aqueous sodium hydroxide solution with a selected sodium chloride content of up to 400 ppm based on pure sodium hydroxide in the cathode compartment at high current efficiency by carrying out the electrolysis under conditions so that a preselected value of the expression:

$$(F(C-C_O)/KVt_m)$$

is not higher than $2.74\times 10^{-4}$, by controlling the difference of concentration of sodium chloride in the anode compartment in eq. cm$^{-3}$ and the limiting concentration of sodium chloride in the anode compartment in eq. cm$^{-3}$ at a value from 0 to 0.001 eq. cm$^{-3}$; the symbols in the said expression being defined as follows:

F is the Faraday constant expressed as 96,500 sec. eq.$^{-1}$,

C is the concentration of sodium chloride in the anode compartment in eq. cm$^{-3}$, $C_O$ is the limiting concentration of sodium chloride in the anode compartment in eq. cm$^{-3}$, K is a proportionality constant in sec. cm$^{-3}$ ohm$^{-1}$, V is the voltage drop in the membrane in volts, and $t_m$ is the transport number of the sodium ions in the membrane:

and

F is 96,500, $C-C_O$ is from 0 to 0.001,

K is from $0.8\times 10^5$ to $1.67\times 10^5$,

V is from 0.3 to 2, and $t_m$ is from 0.7 to 0.98.

2. A process as in claim 1 wherein the alkali metal halide is sodium chloride and the value of $t_m$ is from 0.8 to 0.98.

3. A process as in claim 1 carried out at a current density of from 1 amp. cm.$^{-2}$ to 0.05 amp. cm.$^{-2}$ under conditions such that the ratio of current density to limiting concentration is from 150 to 350 amp. cm.$^{-2}$/eq. cm.$^{-3}$.

4. A process as in claim 1 wherein the cation exchange membrane is a fluorocarbon polymer containing sulfonic acid groups.

5. A process as in claim 1 wherein the cation exchange membrane is provided with a reinforcing material backing.

6. A process as in claim 5 wherein the reinforcing material backing comprises a polytetrafluoroethylene fabric.

* * * * *

UNITED STATES PATENT AND TRADEMARK OFFICE

CERTIFICATE OF CORRECTION

PATENT NO. : 4,276,130

DATED : June 30, 1981

INVENTOR(S) : Seko et al.

It is certified that error appears in the above—identified patent and that said Letters Patent is hereby corrected as shown below:

On the title page, Item (30)"Foreign Application Priority Data", "July 11, 1975 should read -- July 15, 1975 --.

Signed and Sealed this

*Twenty-ninth* Day of *September 1981*

[SEAL]

*Attest:*

GERALD J. MOSSINGHOFF

*Attesting Officer*

*Commissioner of Patents and Trademarks*